US010584870B2

(12) United States Patent
White

(10) Patent No.: US 10,584,870 B2
(45) Date of Patent: Mar. 10, 2020

(54) CANDLE WICK TRIMMING ASSEMBLY

(71) Applicant: Taylor White, Mankato, MN (US)

(72) Inventor: Taylor White, Mankato, MN (US)

( * ) Notice: Subject to any disclaimer, the term of this patent is extended or adjusted under 35 U.S.C. 154(b) by 0 days.

(21) Appl. No.: 16/000,361

(22) Filed: Jun. 5, 2018

(65) Prior Publication Data

US 2019/0368724 A1 Dec. 5, 2019

(51) Int. Cl.
*F23D 3/36* (2006.01)
*B26B 13/22* (2006.01)
*B26B 17/00* (2006.01)

(52) U.S. Cl.
CPC ..... *F23D 3/36* (2013.01); *B26B 13/22* (2013.01); *B26B 17/006* (2013.01)

(58) Field of Classification Search
CPC ..... F23D 3/36; B26B 13/06; B26B 13/22; B26B 17/006
USPC ..... 431/120; D8/57; 30/90.1, 91.2, 112, 30/124, 131, 178, 179, 186, 191, 233, 30/254, 286, 287
See application file for complete search history.

(56) References Cited

U.S. PATENT DOCUMENTS 18,713 A * 11/1857 Stow et al. ..... B26B 13/00 30/131
36,590 A * 9/1862 Eagle ..... B23D 29/023 30/131
169,785 A * 11/1875 De Zeng ..... F21V 37/00 431/120
177,546 A * 5/1876 Nugent ..... B23D 29/023 30/131
247,888 A * 10/1881 Clark ..... B26B 13/00 431/120
249,818 A * 11/1881 Bailey ..... B23D 29/023 30/131
893,669 A * 7/1908 Steel ..... B23D 29/023 30/131
2,400,220 A * 5/1946 Bell ..... B26B 13/06 30/229
2,994,321 A * 8/1961 Tischler ..... A61B 10/02 606/174
3,336,666 A * 8/1967 Calkin ..... H02G 1/1212 30/90.1
4,597,385 A * 7/1986 Watson ..... A61B 10/0291 606/116
4,872,455 A * 10/1989 Pinchuk ..... A61B 17/3201 606/174
4,876,795 A * 10/1989 Chun-Cheng ..... B26B 13/06 30/254

(Continued)

FOREIGN PATENT DOCUMENTS

DE 2725846 C2 * 11/1979 ..... F23D 3/36

*Primary Examiner* — Jason Daniel Prone

(57) ABSTRACT

A candle wick trimming assembly includes a pair of scissors that is insertable into a candle jar. A first box is coupled to a distal end of a a first scissor body the scissors and the first box is positionable to abut a top of the candle. A first blade is coupled to the first box and the first blade is spaced approximately 3.0 mm from an end of the first box positionable on the top of the candle. A second box is coupled to a distal end of a second scissor body of the scissors and the second box is urged toward the first box when the scissors are closed. A second blade is coupled to the second box and the second blade engages the first blade when the scissors are closed to cut the wick.

5 Claims, 5 Drawing Sheets

(56) References Cited

U.S. PATENT DOCUMENTS

| | | | | | |
|---|---|---|---|---|---|
| 5,379,521 | A * | 1/1995 | Lynders | B26B 13/00 | 30/233 |
| D422,470 | S * | 4/2000 | Mosca | D8/57 | |
| 6,076,262 | A * | 6/2000 | Pappas | B26B 13/00 | 30/179 |
| 6,243,954 | B1 * | 6/2001 | Bowers | B26B 13/00 | 30/233 |
| D458,100 | S * | 6/2002 | Bowers | D8/57 | |
| 6,405,441 | B1 * | 6/2002 | Rucker | B26B 17/00 | 30/179 |
| 6,619,950 | B2 | 9/2003 | Ricci | | |
| 6,813,832 | B2 * | 11/2004 | Alexander | B26B 13/22 | 30/233 |
| D503,326 | S | 3/2005 | Mildon | | |
| 7,017,273 | B2 * | 3/2006 | Foster | B26B 17/006 | 30/287 |
| 7,047,851 | B2 | 5/2006 | Waisath | | |
| 7,104,785 | B2 | 9/2006 | Feaser | | |
| 7,415,744 | B1 | 8/2008 | Williams | | |
| D593,825 | S * | 6/2009 | Huie | D8/57 | |
| 7,744,367 | B1 | 6/2010 | Kudyba | | |
| 9,080,767 | B1 | 7/2015 | Garlington | | |
| D743,767 | S * | 11/2015 | Montague | D8/57 | |
| D831,457 | S * | 10/2018 | Bowers | D8/57 | |
| D833,689 | S * | 11/2018 | Carrigan | D8/57 | |
| 2003/0172533 | A1 | 9/2003 | Alexander | | |
| 2004/0166452 | A1 * | 8/2004 | McInnis | B26B 13/00 | 431/120 |
| 2005/0039335 | A1 | 2/2005 | Forsberg | | |
| 2007/0157473 | A1 * | 7/2007 | Varnell | B26B 13/22 | 30/194 |
| 2017/0102141 | A1 * | 4/2017 | Bowers | F23D 3/36 | |

* cited by examiner

CANDLE WICK TRIMMING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to trimming devices and more particularly pertains to a new trimming device for trimming a candle wick to 3.0 mm in length.

BRIEF SUMMARY OF THE INVENTION

An embodiment of the disclosure meets the needs presented above by generally comprising a pair of scissors that are extendable downwardly into a candle jar for trimming a wick of the candle. A first box is coupled to the distal end of a respective one of the scissors and the first box abuts a top of the candle. A first blade is coupled to the first box and the first blade is spaced approximately 3.0 mm from the top of the candle when the first box is positioned on the top of the candle. A second box is coupled to the distal end of a respective one of the scissors and the second box is urged toward the first box when the scissors are closed. A second blade is coupled to the second box and the second blade engages the first blade when the scissors are closed to cut the wick.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
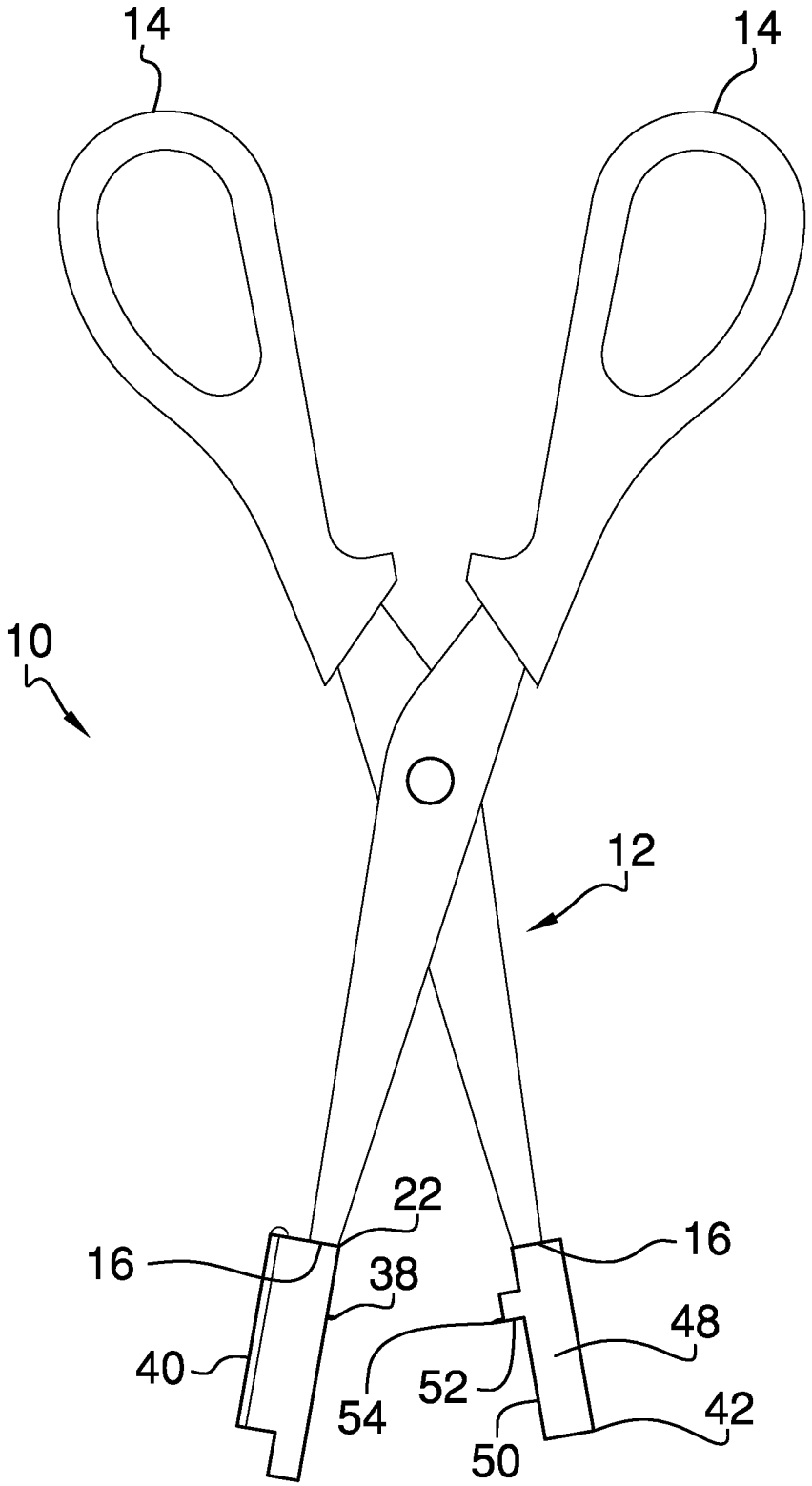
FIG. 1 is a front view of a candle wick trimming assembly according to an embodiment of the disclosure in an open position.
Figure 2:
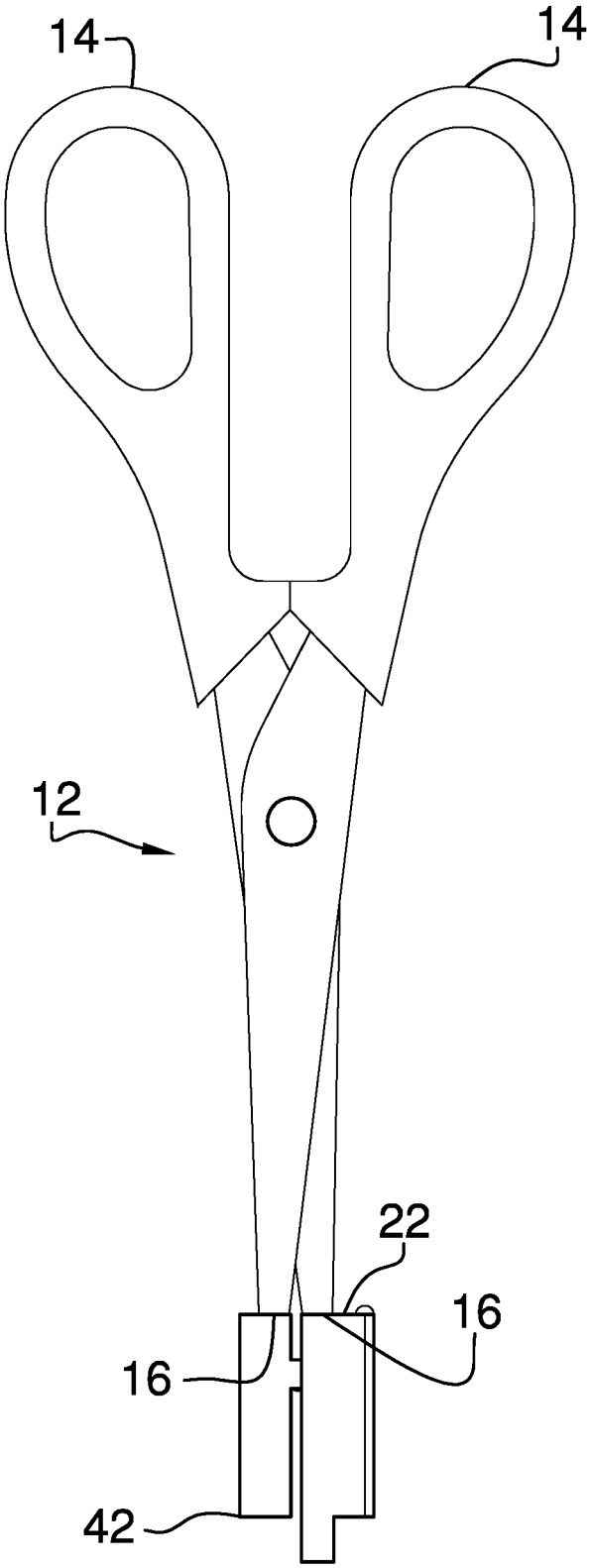
FIG. 2 is a front view of an embodiment of the disclosure in a closed position.
Figure 3:
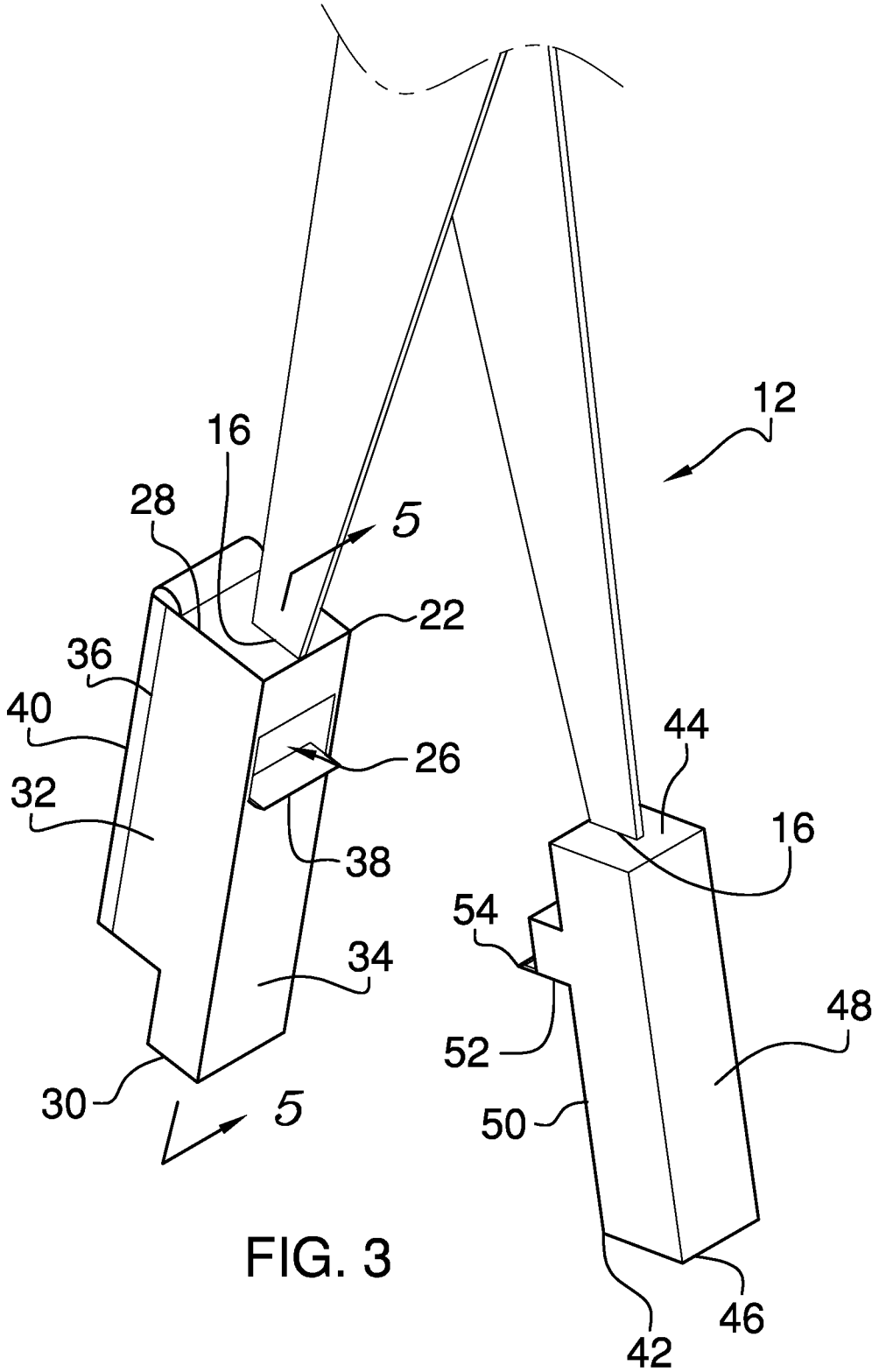
FIG. 3 is a perspective view of an embodiment of the disclosure.
Figure 4:
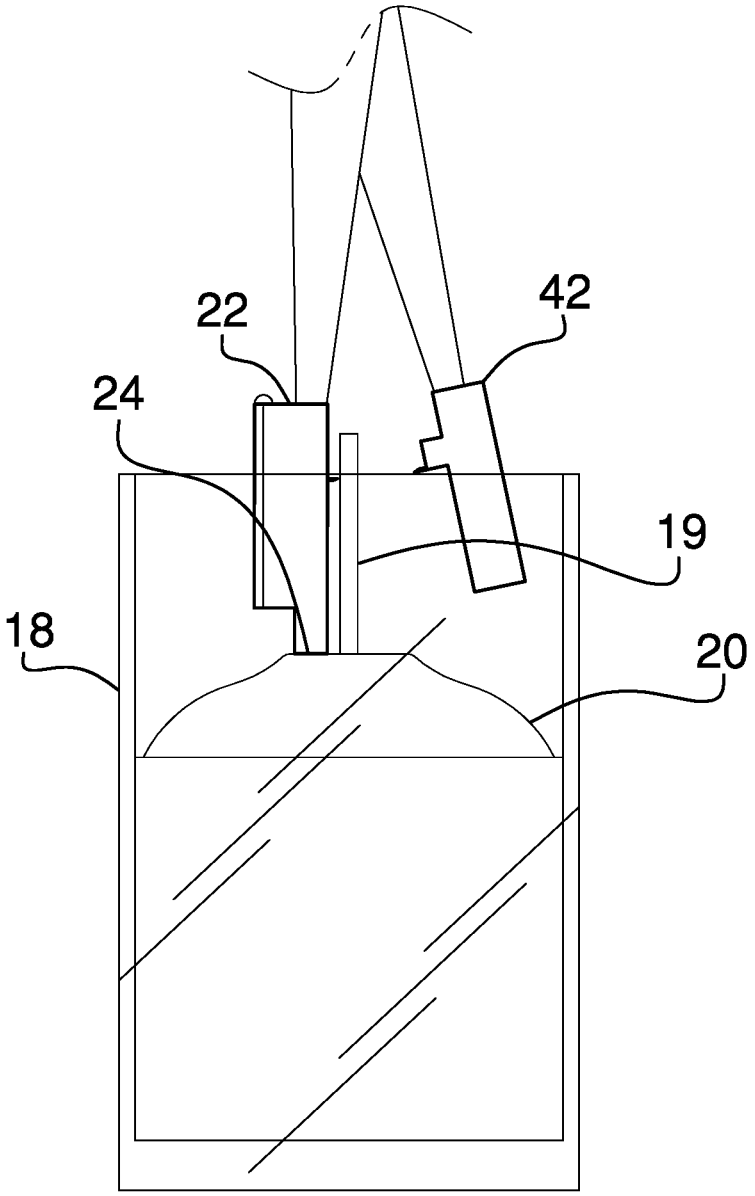
FIG. 4 is a perspective in-use view of an embodiment of the disclosure.
Figure 5:
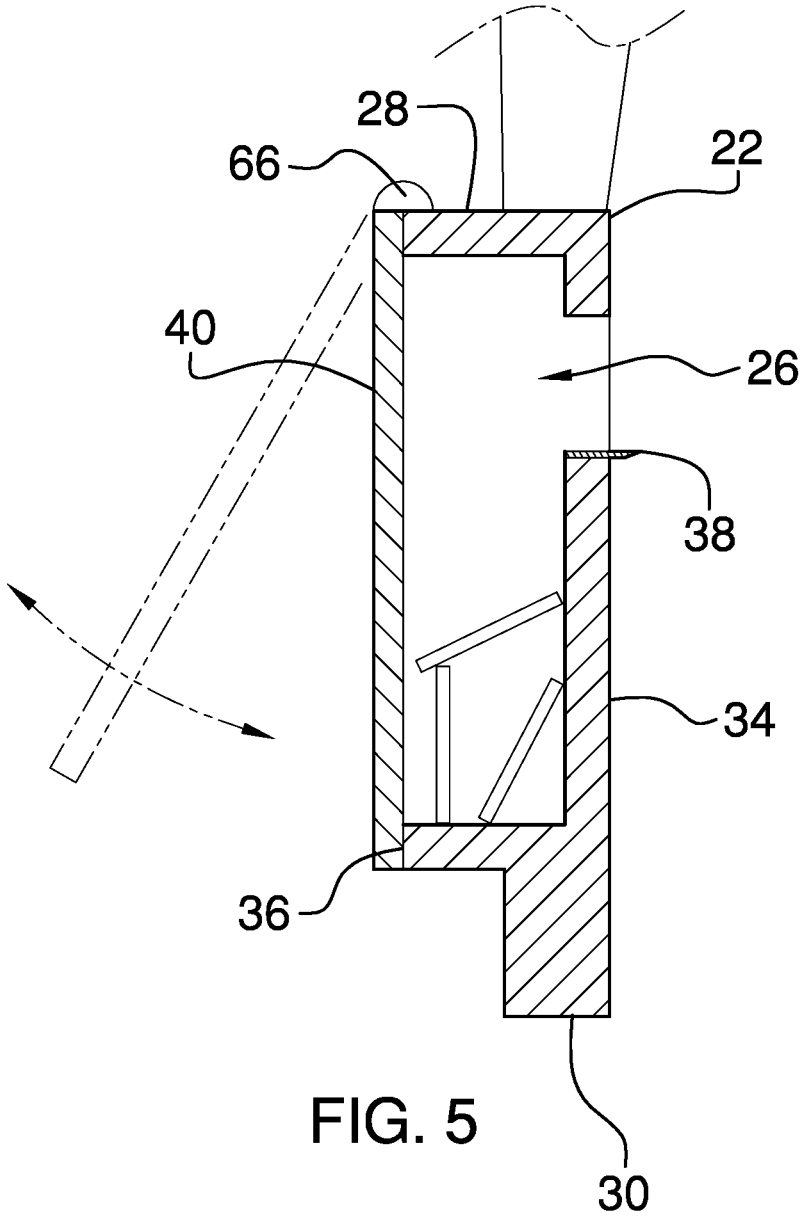
FIG. 5 is a cross sectional view taken along line 5-5 of FIG. 3 of an embodiment of the disclosure.

With reference now to the drawings, and in particular to FIGS. 1 through 5 thereof, a new trimming device embodying the principles and concepts of an embodiment of the disclosure and generally designated by the reference numeral 10 will be described.

As best illustrated in FIGS. 1 through 5, the candle wick trimming assembly 10 generally comprises a pair of scissors 12. The scissors 12 has a first scissor body and a second scissor body pivotally coupled together. Each of the first scissor body and the second scissor body has a handle end 14 for gripping and a distal end 16 with respect to the handle end 14. The distal end 16 of each of the first scissor body and the second scissor body is urged toward each other when the scissors 12 are closed. Alternatively, the distal end 16 of each of the first scissor body and the second scissor body is urged away from each other when the scissors 12 are opened. The scissors 12 are insertable into a candle jar 18 for trimming a wick 19 of the candle 20 or for trimming the wick 19 of a freestanding candle 20 that is not in a jar or any other sort of container as described further below.

A first box 22 is coupled to the distal end 16 of the first scissor body and the first box 22 is positionable to abut a top 24 of the candle 20 when the scissors 12 are inserted into the candle jar 18. The first box 22 has an opening 26 extending into an interior of the first box 22. Moreover, the first box 22 has a top wall 28, a bottom wall 30 and an outer wall 32 extending therebetween, and the outer wall 32 has a front side 34 and a back side 36. The opening 26 is positioned on the front side 34, the back side 36 is open, the top wall 28 is coupled to the distal end 16 of the respective scissor 12 and the bottom wall 30 abuts the top 24 of the candle 20.

A first blade 38 is coupled to the first box 22 and the first blade 38 is spaced approximately 3.0 mm from the bottom wall 30 such that the first blade 38 is configured to be positioned approximately 3.0 mm from the top 24 of the candle 20 when the bottom wall 30 of the first box 22 is positioned on the top of the candle 20. Thus, the first blade 38 is positioned to trim the wick 19 to the optimum length for minimizing soot when the wick 19 is burned. The first blade 38 cuts the wick 19 in the candle 20 when the scissors 12 are closed on the wick 19. The first blade 38 is positioned extending from the front side 34 of the outer wall 32 of the first box 22 and the first blade 38 extends along a line that is perpendicular to a longitudinal axis of the first scissor body. Moreover, the first blade 38 is positioned in the opening 26 in the first box 22 such that the opening 26 receives trimmings from the wick 19. A door 40 is hingedly coupled to the top wall 28 of the first box 22 by a hinge 66 to close the back side 36 and the door 40 is opened to empty the trimmings from the first box 22. The door 40 frictionally engages the box to releasably retain the door 40 in a closed position.

A second box 42 is coupled to the distal end 16 of the second scissor body and the second box 42 is urged toward the first box 22 when the scissors 12 are closed. The second box 42 has an upper wall 44, a lower wall 46 and an exterior wall 48 extending therebetween, and the exterior wall 48 has a forward side 50. The upper wall 44 is coupled to the distal end 16 of the respective scissor 12 having the forward side 50 of the exterior wall 48 of the second box 42 being directed toward the front side 34 of the outer wall 32 of the first box 22. Additionally, the forward side 50 has a protrusion 52 thereon and the protrusion 52 is aligned with the opening 26 in the first box 22 when the scissors 12 are closed.

A second blade 54 is coupled to the second box 42 and the second blade 54 engages the first blade 38 when the scissors 12 are closed for cutting the wick 19. The second blade 54 extends along a line that is oriented perpendicular to the longitudinal axis of the the second scissor body. Moreover, the second blade 54 is positioned on the protrusion 52 on the forward side 50 of the exterior wall 48 of the second box 42. The protrusion 52 enters the opening 26 in the first box 22 when the scissors 12 are closed thereby urging the trimming into the opening 26.

In use, the handle end 14 of each of the first scissor body and the second scissor body is gripped and the distal end 16 of the first scissor body and the second scissor body is inserted into the candle jar 18 until the bottom wall 30 of the first box 22 abuts the top of the candle 20. The scissors 12 are closed such that the first 38 and second 54 blades trim the wick 19 on the candle 20. Additionally, the protrusion 52 on the second box 42 urges the trimming into the opening 26 in the first box 22 to collect the trimming. In this way the wick 19 on the candle 20 is trimmed to the optimum length for burning the candle 20 without producing soot. The door 40 on the first box 22 is opened to empty the trimming from the first box 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A candle wick trimming assembly being configured to trim a wick on a candle and collect the trimmings, the assembly comprising:

a scissors having a first scissor body pivotally coupled to a second scissor body each having a handle end for gripping and a distal end with respect to the handle end, the scissors being insertable into a candle jar;

a first box being coupled to the distal end of the first scissor body, the first box being configured to abut a top of the candle when the scissors are extended into the candle jar, the first box having an opening extending into an interior of the first box;

a first blade being coupled to the first box in the opening, the first blade being spaced approximately 3.0 mm from a bottom wall of the first box such that the first blade is configured to be positioned approximately 3.0 mm from the top of the candle when the bottom wall of the first box is positioned on the top of the candle;

a second box being coupled to the distal end of the second scissor body, the second box being moved toward the first box when the scissors are closed; and a second blade being coupled to the second box, the second blade engaging the first blade when the scissors are closed such that the first blade and second blade are configured to cut a wick extending from the top of the candle to a length of approximately 3.0 mm when the bottom wall of the first box is positioned on the top of the candle.

2. The assembly according to claim 1, wherein:

the distal end of each of the first scissor body and the second scissor body being moved toward each other when the scissors are closed, the distal end of each of the first scissor body and the second scissor body being moved away from each other when the scissors are opened;

the first box has a top wall and an outer wall extending between the top wall and the bottom wall, the outer wall having a front side and a back side, the opening being positioned on the front side, the back side defining an opening into the interior, the top wall being coupled to the distal end of the first scissor body; and the first blade being positioned to extend from the front side of the outer wall of the first box, the first blade extending along a line being perpendicular to a longitudinal axis of the first scissor body, the first blade being positioned in the opening in the first box such that the opening is configured to receive trimmings from the wick.

3. The assembly according to claim 2, further comprising a door being hingedly coupled to the top wall of the first box to close the back side opening, the door being openable wherein the door is configured to facilitate emptying the trimmings from the interior of the first box.

4. The assembly according to claim 2, wherein:

the second box has an upper wall, a lower wall and an exterior wall extending therebetween, the exterior wall having a forward side, the upper wall being coupled to the distal end of the second scissor body having the forward side of the exterior wall of the second box being directed toward the front side of the outer wall of the first box, the forward side having a protrusion thereon; and the second blade extends along a line being oriented perpendicular to the longitudinal axis of the second scissor body, the second blade being positioned on the protrusion on the forward side of the exterior wall of the second box, the protrusion entering the front side opening in the first box when the scissors are closed thereby urging the trimming into the front side opening.

5. A candle wick trimming assembly being configured to trim a wick on a candle and collect the trimmings, the assembly comprising:

a scissors having a first scissor body pivotally coupled to a second scissor body each having a handle end for gripping and a distal end with respect to the handle end, the distal end of each of the first scissor body and the second scissor body being moving toward each other when the scissors are closed, the distal end of each of the first scissor body and the second scissor body being moving away from each other when the scissors are opened, the scissors being insertable into a candle jar;

a first box being coupled to the distal end of the first scissor body, the first box being configured to abut a top of the candle when the scissors are extended inserted into the candle jar, the first box having an opening extending into an interior of the first box, the first box having a top wall, a bottom wall and an outer wall extending therebetween, the outer wall having a front side and a back side, the opening being positioned on the first side, the back side defining an opening into the interior, the top wall being coupled to the distal end of the first scissor body;

a first blade being coupled to the first box, the first blade being spaced approximately 3.0 mm from bottom wall of the first box the first blade being positioned on the front side of the outer wall of the first box, the first blade extending along a line being perpendicular to a longitudinal axis of the first scissor body, the first blade being positioned in the front side opening in the first box such that the front side opening is configured receive trimmings from the wick;

a door being hingedly coupled to the back side of the outer wall of the first box to close the back side opening, the door being openable such that the door is configured to facilitate emptying the trimmings from the interior of the first box;

a second box being coupled to the distal end of the second scissor body, the second box being moved toward the first box when the scissors are closed, the second box having an upper wall, a lower wall and an exterior wall extending therebetween, the exterior wall having a forward side, the upper wall being coupled to the distal end of the second scissor body having the forward side of the exterior wall of the second box being directed toward the front side of the outer wall of the first box, the forward side having a protrusion thereon; and a second blade being coupled to the second box, the second blade engaging the first blade when the scissors are closed such that the first blade and second blade are configured to cut the wick extending from the top of the candle to a length of approximately 3.0 mm when the bottom wall of the first box is positioned on the top of the candle, the second blade extending along a line being oriented perpendicular to the longitudinal axis of the second scissor body, the second blade being positioned on the protrusion on the forward side of the exterior wall of the second box, the protrusion entering the opening in the first box when the scissors are closed thereby urging the trimming into the front side opening.

* * * * *